United States Patent [19]

Rodgers, Sr.

[11] 3,988,631

[45] Oct. 26, 1976

[54] PIN FOR SUPPORTING THE APERTURE MASK IN A COLOR TELEVISION PICTURE TUBE

[75] Inventor: Harris G. Rodgers, Sr., Corning, N.Y.

[73] Assignee: Corning Glass Works, Corning, N.Y.

[22] Filed: Nov. 6, 1975

[21] Appl. No.: 629,646

[52] U.S. Cl. ..... 313/402
[51] Int. Cl.[2] ..... H01J 29/02
[58] Field of Search ..... 313/402, 404–408

[56] References Cited

UNITED STATES PATENTS 2,824,990 2/1958 Haas ..... 313/402

*Primary Examiner*—James B. Mullins
*Attorney, Agent, or Firm*—Charles W. Gregg; Burton R. Turner; Clarence R. Patty, Jr.

[57] ABSTRACT

A pin or stud for support of a shadow or an aperture mask in or on a color television picture or cathode ray tube envelope, such pin or stud comprising a generally channel-shaped member having side portions longer than the central portion of the member and such member having geometric symmetry both on opposite sides of a first plane extending through the center of the central portion of the pin parallel with a first pair of opposite edges of such portion and also on opposite sides of a second plane extending through said center parallel with the other or second pair of opposite edges of the central portion of the pin and normal to said first plane. A pair of corresponding ends of said side portions of the pin are adapted for embedment in said envelope.

8 Claims, 5 Drawing Figures

PIN FOR SUPPORTING THE APERTURE MASK IN A COLOR TELEVISION PICTURE TUBE

BACKGROUND OF THE INVENTION

There is, for example, disclosed in copending application Ser. No. 526,138, filed Nov. 22, 1974 by W. C. Palmer and Richard L. Seely, and assigned to the same assignee as the present application a generally channel-shaped pin for support of an aperture mask in or on the envelope of a color television picture tube, such pin having a first end including a pair of legs for embedment in the glass of the picture tube envelope. In the employment of an apparatus for automatic handling such pins and inserting the pins in the tube envelopes, it was found that the wrong ends of some of the pins, that is, the ends of the pins on which said pair of legs was not included, would often be in position to be inserted into the tube envelope. Attempts to correct this problem were not too successful and, therefore, the pin of the present invention was developed, that is, there was developed a pin which is geometrically symmetrical and, therefore, regardless of which end thereof is positioned for insertion into tube envelopes such insertion can be made and the pin will be suitably oriented for support of an aperture mask.

It is, therefore, an object of the present invention to provide a novel type of aperture mask support pin for support of an aperture mask in a color television picture tube envelope.

It is another object of the present invention to provide a support pin of the class mentioned and which is geometrically symmetrical on opposite sides of two planes extending normal or perpendicular to each other so that the pin can be turned end for end, that is, so that either end of the pin can be inserted in a picture tube envelope and the same structure or arrangement results.

Other objects and characteristic features of the invention will become apparent as the description proceeds.

SUMMARY OF THE INVENTION

The invention is believed to be adequately summarized in the foregoing abstract of the disclosure and, therefore, to prevent repetition or redundancy and for sake of brevity of the application to the extent possible, no further summary of the invention will be given nor is any believed necessary.

BRIEF DESCRIPTION OF THE DRAWINGS

In the drawings.

Similar reference characters refer to similar parts in each of the Figs. of the drawings.

PREFERRED EMBODIMENTS OF THE INVENTION

Figure 1:
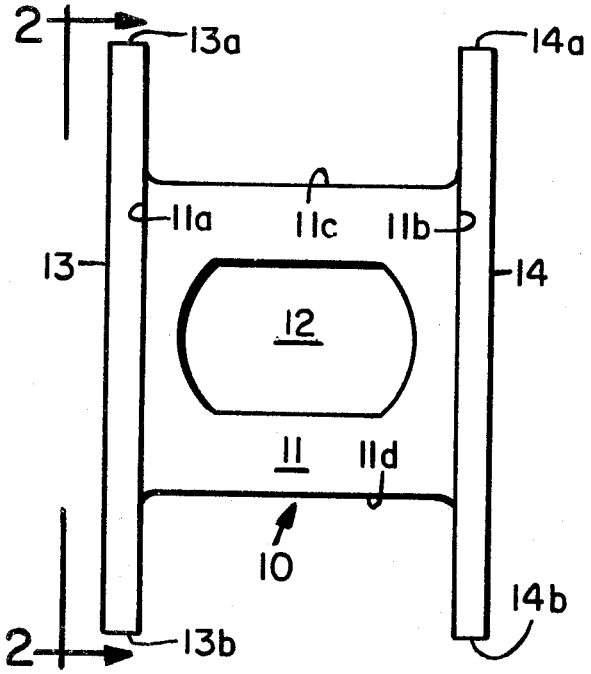
FIG. 1 is a front elevational view of one type of aperture mask support pin in accordance with the invention.
Figure 2:
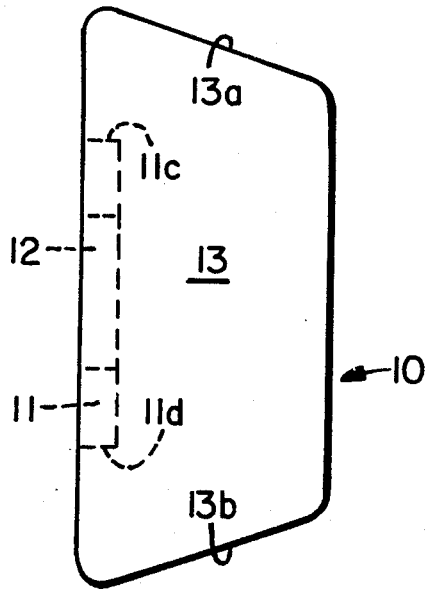
FIG. 2 is a side elevational view of the pin of FIG. 1, such view being taken generally along line 2—2 of FIG. 1.

Referring to FIGS. 1 and 2 of the drawings in detail, there is shown an aperture mask support pin 10 including a flat central portion 11 embodying a substantially or generally obround orifice or opening 12 extending through the center region of such portion 11 for receipt of a projecting support member of an aperture mask to be supported by a plurality of such pins. The straight sides of abround orifice 12 parallel the upper and lower edges 11*c* and 11*d* of central portion 11 of pin 10 (viewing FIG. 1). Central portion 11, as well as opening 12 embodied therein, is geometrically symmetrical on opposite sides of each of first and second vertical and horizontal planes, respectively, as shown in FIG. 1. That is to say, central portion 11 of pin 10 (as well as pin 10 per se as hereinafter pointed out) has geometric symmetry both on opposite sides of a first plane extending through the center of said central portion 11 of the pin parallel with a first pair of opposite edges 11*a* and 11*b* of such central portion, and also on opposite sides of a second plane extending through said center of central portion 11 normal to said first plane and parallel with the second pair of opposite edges 11*c* and 11*d* of such portion 11.

Pin 10 further includes a pair of similar side portions 13 and 14 extending at right angles from the first pair of opposite edges 11*a* and 11*b* of central portion 11 of pin 10. Such side portions 13 and 14 have a length greater than the length of central portion 11 and, as mentioned above, since pin 10 has geometric symmetry on opposite sides of both of vertical and horizontal planes extending normal to each other, side portions 13 and 14 extend above central portion 11 the same distance that such side portions extend below such central portion. The edges 13*a* and 13*b*, and 14*a* and 14*b*, of the upper and lower ends of side portions 13 and 14, respectively, correspondingly slope to a lesser length in a direction away from central portion 11 of pin 10 as best illustrated in FIG. 2 in relation to side portion 13. While the sloping of said ends of the side portions of pin 10 is not crucial, such slopes are provided so that said ends will generally conform to the curvature of a viewing panel or face plate of a television picture or cathode ray tube as discussed in conjunction with FIG. 5.

Figure 3:
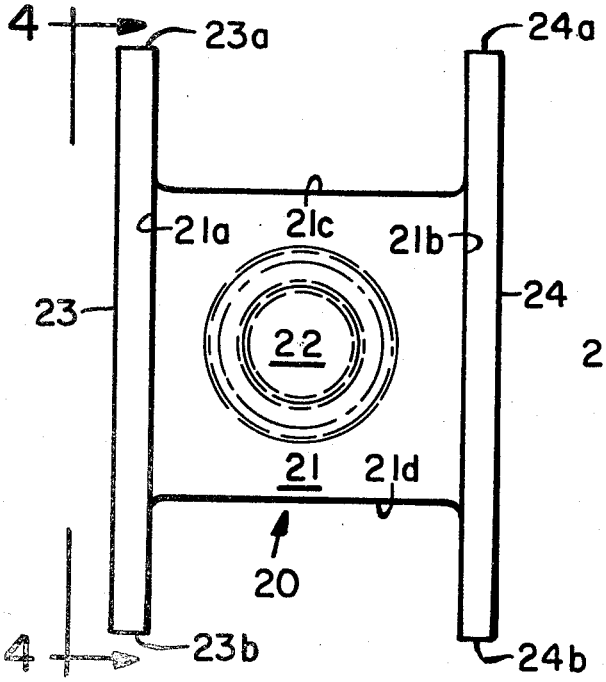
FIG. 3 is a front elevational view of another type of aperture mask support pin in accordance with the invention.
Figure 4:
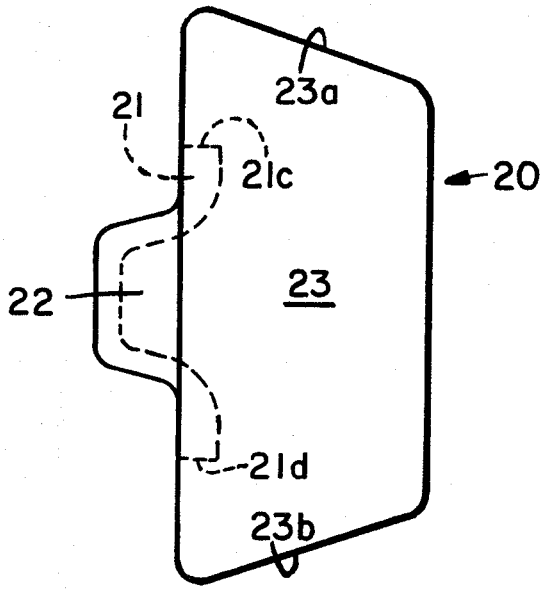
FIG. 4 is a side elevational view of the pin of FIG. 3, such view being taken generally along line 4—4 of FIG. 3.

Referring now to FIGS. 3 and 4 of the drawings in detail, there is shown another type of aperture mask support pin 20 having a central portion 21 embodying a tapered circular projection 22 which extends from the center or center region of a face of central portion 21 with the center axis of such projection normal to such central portion. Such projection 22 is for making retentive coupling engagement with a support member of an aperture mask to be supported by a plurality of mask support pins. Such support member would embody an orifice or opening complemental to a projection such as 22.

For purposes of brevity of this description it is believed expedient to point out that pin 20 is, with the exception of the projection which is used in place of the orifice or opening 12 in pin 10 for aperture mask support, similar in structure to and used similarly as a pin such as 10. Therefore, the parts of pin 20 indicated by reference characters 21, 21*a*, 21*b*, 21*c*, 21*d*, 23, 24, 23*a*, 23*b*, 24*a* and 24*b* of FIGS. 3 and 4 correspond respectively to the parts of pin 10 indicated by reference characters 11, 11*a*, 11*b*, 11*c*, 11*d*, 13, 14, 13*a*, 13*b*, 14*a* and 14*b* of FIGS. 1 and 2. It is believed that this will be readily apparent from a brief glance at said drawing figures and no further detailed description of the embodiment of the invention shown in FIGS. 3 and 4 is considered necessary.

Figure 5:
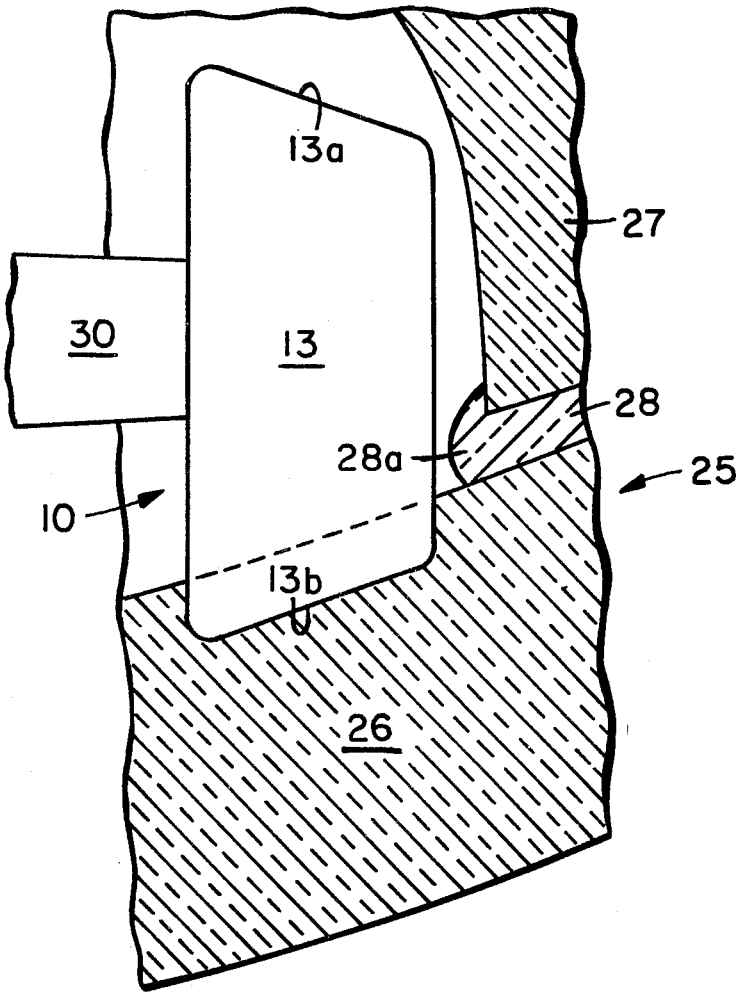
FIG. 5 is a cross-sectional view of a small section of a glass television picture tube envelope with the pin of FIGS. 1 and 2 partly embedded in the envelope.

There is shown in FIG. 5 of the drawings a pin such as 10, a pair of corresponding ends of the side portions 13 and 14 of which are partially inserted into a curved glass face plate or viewing panel 26 of the envelope 25 of a television picture or cathode ray tube, an end of side portion 13 being shown in FIG. 5 as so inserted. There is also shown in FIG. 5 a section of the sidewall of a funnel member 27 for envelope 25 and to which panel 26 is sealed as by a sealing glass frit 28 having a bead 28*a*. It will be readily apparent that this description is equally applicable to the side portions 23 and 24 of a pin such as 20 illustrated in FIG. 3. There is also shown in FIG. 5 a part of a length of a tapered projecting support member 30 of an aperture mask to be supported by pins such as 10, such member extending into the aforesaid orifice or opening 12 provided in central portion 11 of a pin such as 10. As previously mentioned, if a pin such as 20 is used in place of pin 10 shown in FIG. 5, the projection 22 of such pin would extend into a complemental orifice of a support member of an aperture mask.

Although there is herein shown and described only two types of aperture or shadow mask support pins or studs in accordance with the invention, it is to be understood that such is not intended to be in any way limiting but that various changes and modifications may be made therein within the purview of the appended claims without departing from the spirit and scope thereof.

What is claimed is:

1. For use in a color cathode ray tube envelope for supporting an aperture mask on such envelope, a channel-shaped pin having a central portion for making retentive coupling engagement with said mask and a pair of similar side portions extending at similar angles from a first pair of opposite edges of said central portion, such side portions having a length greater than the length of said central portion, such pin having geometric symmetry both on opposite sides of a first plane extending through the center of said central portion of the pin parallel with said first pair of edges, and also on opposite sides of a second plane extending through said center of such central portion normal to said first plane and parallel with a second pair of opposite edges of the central portion, and a pair of corresponding ends of said side portions being adapted for embedment in said envelope.

2. A pin in accordance with claim 1 and in which the edges of the ends of said side portions correspondingly slope, to a lesser length for such portions, in a direction away from said central portion.

3. A pin in accordance with claim 1 and in which the center region of said central portion embodies an opening extending through such portion for making said coupling engagement.

4. A pin in accordance with claim 3 and in which said opening is substantially obround with the parallel sides thereof extending parallel with said second pair of opposite edges of said central portion.

5. A pin in accordance with claim 2 and in which the center region of said central portion embodies an opening extending through such portion for making said coupling engagement.

6. A pin in accordance with claim 5 and in which said opening is substantially obround with the parallel sides thereof extending parallel with said second pair of opposite edges of said central portion.

7. A pin in accordance with claim 1 and in which said central portion includes a tapered circular projection for making said coupling engagement, such projection extending from the center of a face of such central portion with the center axis of the projection normal to such portion.

8. A pin in accordance with claim 2 and in which said central portion includes a tapered circular projection for making said coupling engagement, such projection extending from the center of a face of such central portion with the center axis of the projection normal to such portion.

* * * * *